US005657007A

United States Patent [19]

Anderson et al.

[11] Patent Number: 5,657,007

[45] Date of Patent: Aug. 12, 1997

[54] DUMPSTER ALARM SYSTEM

[76] Inventors: Thomas M. Anderson, 12180 Upper Heather, Hugo, Minn. 55038; Patrick E. Powers, 240 Lee Rd. 793, Salem, Ala. 36874

[21] Appl. No.: 507,567

[22] Filed: Jul. 26, 1995

[51] Int. Cl.[6] ..... G08G 1/00

[52] U.S. Cl. ..... 340/904; 340/539; 340/994

[58] Field of Search ..... 340/904, 902, 340/539, 994

[56] References Cited

U.S. PATENT DOCUMENTS

| | | | |
|---|---|---|---|
| 4,115,757 | 9/1978 | Blahunka | 340/32 |
| 4,307,859 | 12/1981 | Hayashi et al. | 246/124 |
| 4,591,835 | 5/1986 | Sharp | 340/574 |
| 4,910,498 | 3/1990 | Feher | 340/556 |
| 5,021,780 | 6/1991 | Fabiano et al. | 340/994 |
| 5,023,593 | 6/1991 | Brox | 340/522 |
| 5,126,735 | 6/1992 | Trevijano | 340/902 |
| 5,144,301 | 9/1992 | Jackson et al. | 340/994 |
| 5,239,305 | 8/1993 | Murphy et al. | 340/539 |

*Primary Examiner*—Jeffrey Hofsass
*Assistant Examiner*—Julie B. Lieu
*Attorney, Agent, or Firm*—Kinney & Lange, P.A.

[57] ABSTRACT

A remote warning system is provided for signalling to occupants of a garbage dumpster the approach of a garbage truck. A first warning device is carried by the garbage truck. The first warning device has a transmitter for transmitting a first signal indicative of the approach of the garbage truck. A second warning device attached to the garbage dumpster includes a receiver for receiving the first signal and for providing an output in response to receipt of the first signal. An alarm in the second warning device is coupled to the receiver for warning occupants of the garbage dumpster, in response to the output of the receiver, of the approach of the garbage truck.

19 Claims, 2 Drawing Sheets

Fig. 1
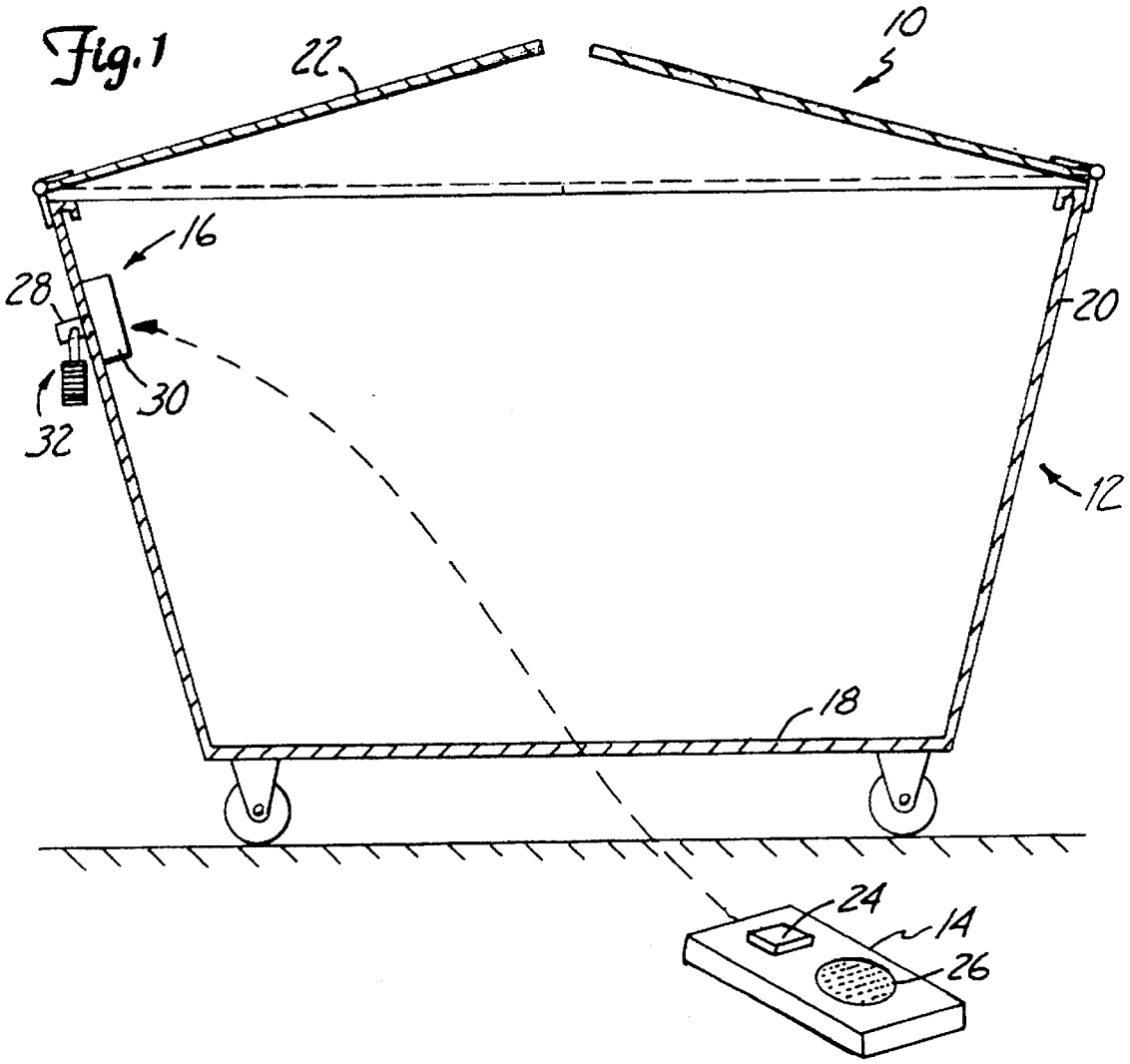
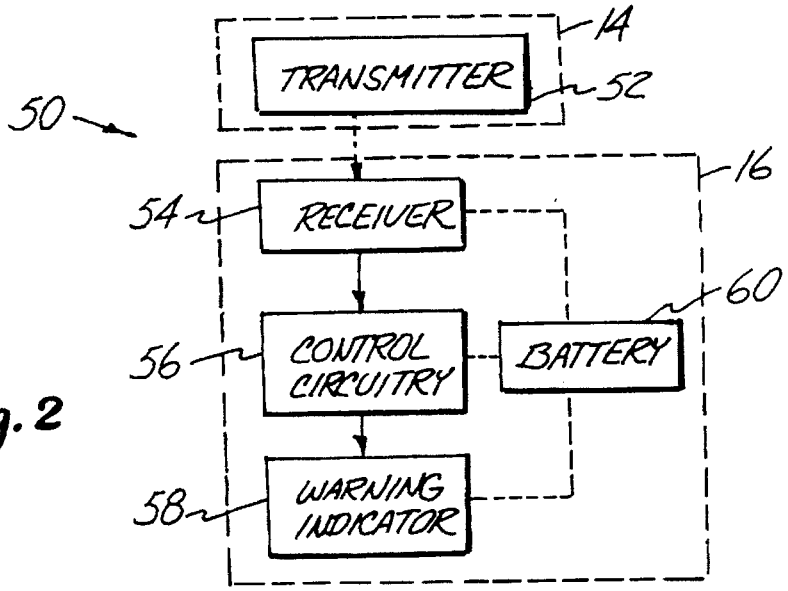
Fig. 2

DUMPSTER ALARM SYSTEM

BACKGROUND OF THE INVENTION

The present invention relates to a system for alerting persons, particularly children, homeless, and vagrants, who may be playing in or occupying a garbage dumpster, of the impending arrival of a garbage truck.

Countless garbage dumpsters are scattered throughout urban and rural areas, particularly in alleys and behind building. The garbage dumpster are located there for easy accessibility during inclement weather by those disposing their garbage therein. Homeless persons and vagrants in need of shelter from inclement weather or a place of solitude will on many occasions occupy these garbage dumpsters. In some instances, the homeless person or vagrant has been using alcohol or drugs which place that person in a stupor or unconscious state such that the approach of a garbage truck would not be recognized.

Children often play in garbage dumpster while playing games such as hide and seek, or while exploring new places. These children may not understand the danger of playing in the garbage dumpster. For example, small children may not immediately associate the sound of an approaching garbage truck with the events which adults know will follow.

Children, homeless persons, and vagrants are killed each year when garbage dumpster are emptied into garbage truck and the garbage is compacted. This serious and many times deadly danger could be reduced if the occupants of the garbage dumpster were warned prior to the emptying of the garbage from the dumpster into the garbage truck. The danger could be reduced even further if the operator of the truck was able to verify the occupancy or lack thereof in the garbage dumpster in a quick and efficient manner.

SUMMARY OF THE INVENTION

A remote warning system is provided for signalling to occupants of a garbage dumpster the approach of a garbage truck. The remote warning system includes a first warning device which is carried by the vehicle. The first warning device has a transmitter for transmitting a first signal indicative of the approach of the garbage truck. A second warning device attached to the garbage dumpster includes a receiver for receiving the first signal and for providing an output in response to receipt of the first signal. An alarm or warning indicator in the second warning device is coupled to the receiver for warning occupants of the garbage dumpster, in response to the output of the receiver, of the approach of the garbage truck. In preferred embodiments, the alarm is a speaker for producing high intensity sound waves to warn the occupants of the garbage dumpster of the approach of the garbage truck. In other preferred embodiments, the alarm is a bright flashing light for producing high intensity light pulses to warn the occupants of the garbage dumpster of the approach of the garbage track.

The system of the present invention may also contain a thermal body heat sensor which is activated when the receiver of the second warning device receives the first signal. When activated, the body heat sensor detects thermal energy in the garbage dumpster and determines whether sufficient heat which may represent the presence of a person is present in the garbage dumpster. If the body heat sensor determines that sufficient heat is present, the alarm is activated to warn the occupant of the garbage dumpster of the impending danger.

In yet another embodiment, of the body heat sensor senses the presence of a person within the garbage dumpster, a transmitter in the second warning device is activated to transmit a second signal. The second signal is received by a receiver in the first warning device. An audible or visual alarm in the first warning device is then activated to warn the garbage truck operator of the occupancy before the dumpster is picked up.

BRIEF DESCRIPTION OF THE DRAWINGS

FIG. 1 is a diagrammatic view of the trash dumpster alarm system of the present invention.

FIG. 2 is a block diagram illustrating first preferred embodiments of the alarm system of the present invention.

DETAILED DESCRIPTION OF THE PREFERRED EMBODIMENTS

Figure 3:
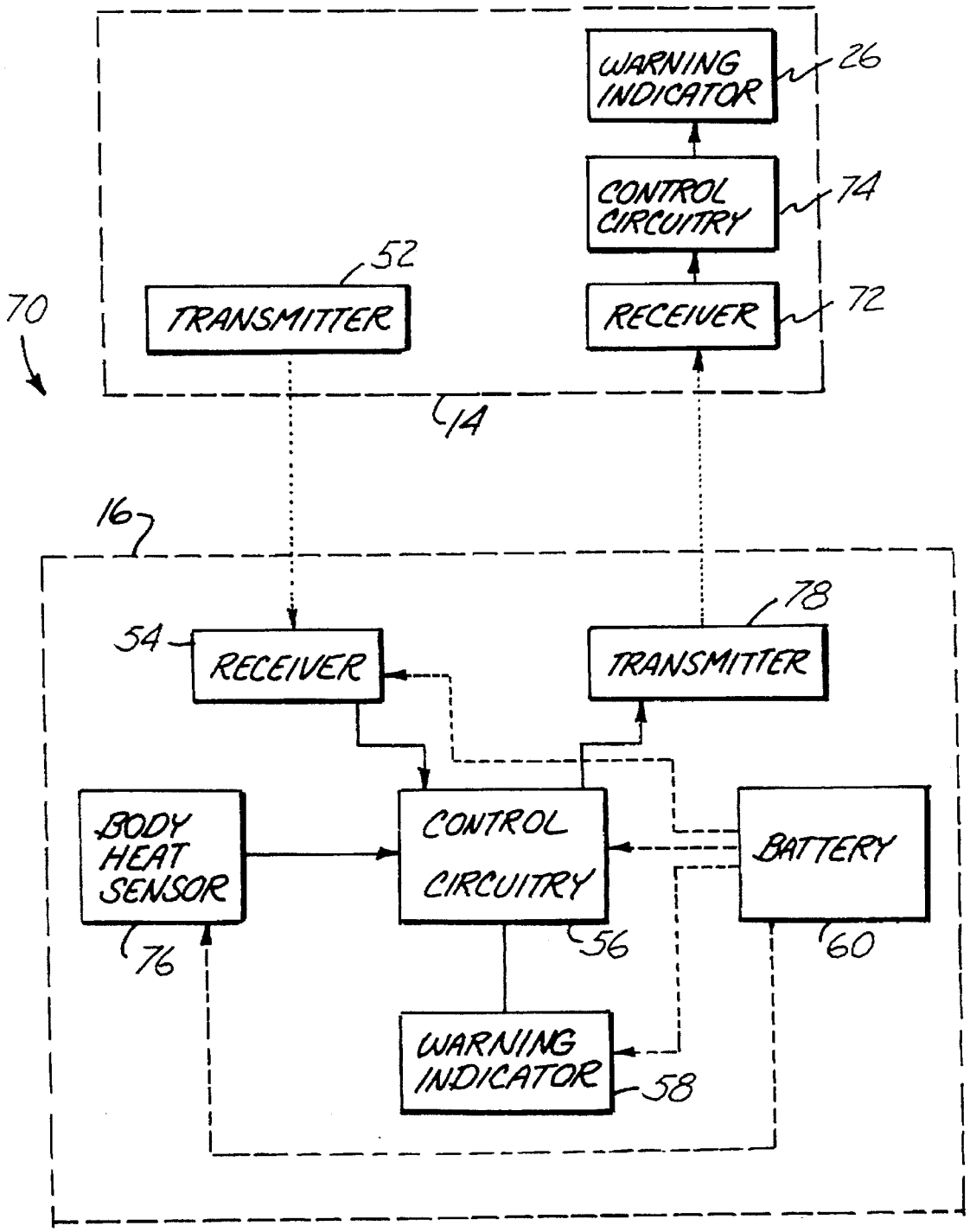
FIG. 3 is a block diagram illustrating second preferred embodiments of the alarm system of the present invention.

The present invention is a remote warning system for signalling to occupants of a garbage dumpster or receptacle the approach of a garbage truck or other vehicle. The remote warning system signals the approach of a garbage truck by transmitting a signal from the garbage truck to a receiver attached to the garbage dumpster. Receipt of the signal activates an alarm which emits either a high decibel warning sound or a bright flashing light so that any person in and around the dumpster can seek safety.

FIG. 1 is a diagrammatic view illustrating remote warning system 10 of the present invention. Remote warning system 10 warns occupants of trash dumpster or receptacle 12 of the approach of a garbage truck. Warning system 10 includes first or truck mounted warning unit 14 and second or trash dumpster mounted warning unit 16.

Dumpster 12 is a trash receptacle of standard construction which typically includes, but is not limited to, floor 18 with four sides 20 attached to floor 18 to form a box with an open top. Dumpster 12 also typically has at least one, and possibly two or four lids 22 that are attached in a standard manner to at least one of sides 20 for covering the open top. Each lid 22 can be selectively opened or dosed based upon the hinged connection to the side.

Warning unit 14 is preferably attached to a garbage truck, but may alternatively be a hand-held unit controlled by a person such as the garbage truck driver. Warning unit 14 transmits a signal which is indicative of the approach of the garbage track. Warning unit 14 may transmit the signal on a continuous basis when turned on. Alternatively, in other preferred embodiments, warning unit 14 includes switch 24 for manual activation of warning unit 14. In these embodiments, warning unit 14 transmits a signal to warning unit 16 only when switch 24 is activated by the driver or another person in the garbage truck. In embodiments in which warning unit 14 includes switch 24, an operator is required to activate switch 24 as the garbage truck approaches each garbage dumpster.

As will be discussed in more detail with reference to FIG. 3, in some preferred embodiments, warning unit 14 is also capable of receiving a signal originating from warning unit 16. In these embodiments, indicator or alarm 26 is controlled to verify to the driver of the garbage truck that warning unit 16 received the signal from warning unit 14, or to notify the driver that one or more persons currently occupy dumpster 12.

Warning unit 16 is connected to garbage dumpster 12 so that a high decibel warning signal emitted by warning unit 16 in response to receipt of a signal from warning unit 14 will be clearly heard by any individual in or around the dumpster. Thus, any occupant of the dumpster is clearly warned of the impending danger associated with dumping of the dumpster.

In one embodiment, warning unit 16 has an attachment arm 28 which is connected to a main section 30. Attachment arm 28 is inserted into a slot in one of sides 20 of dumpster 12 such that a portion of attachment arm 28 protrudes away from dumpster 12 so that a locking mechanism 32 may be attached thereto.

Locking mechanism 32 may be any locking device capable of attaching warning unit 16 to dumpster 12 such that warning unit 16 can not be removed without a key or similar device. In one embodiment, locking mechanism 32 includes a hole through attachment, arm 28 which receives a standard padlock for prohibiting arm 28, when the padlock is inserted into the hole, from being removed from the slot in dumpster 12. For this embodiment, when warning unit 16 needs replacement, the padlock is removed and warning unit 16 is pushed or allowed to fall into dumpster 12. It is therefore desirable to manufacture warning unit 16 out of inexpensive materials which can be disposed of rather than reused so that warning unit 16 can be periodically replaced with a new unit, the old unit being left in the dumpster as garbage.

FIG. 2 illustrates a first embodiment 50 of warning system 10 in accordance with the present invention. As shown in FIG. 2, warning system 50 includes first or truck mounted warning unit 14 and second or dumpster mounted warning unit 16. Warning unit 14 includes transmitter 52 for generating a first signal capable of transmission to warning unit 16. In preferred embodiments, transmitter 52 generates electromagnetic waves, such as radio waves, at a preselected frequency and transmission power. The power of the first signal that transmitter 52 produces should be sufficient to reach warning unit 16 when warning unit 14 and warning unit 16 are separated by a distance of several hundred feet. In one embodiment, the power of the signal produced by transmitter 52 is such that warning unit 16 can be activated by warning unit 14 up to the point where warning unit 14 and warning unit 16 are separated by a maximum distance of 200 feet. Alternatively, the maximum distance can be of a larger or smaller dimension, such as 50 feet, or transmitter 52 may be capable of adjustment so that the operator can determine in a specific setting the maximum distance of separation which will allow for warning unit 16 activation.

The maximum distance that warning unit 16 can receive a signal from warning unit 14 can be pre-set to any of a wide range of values. However, the power of the signal from transmitter 52 is ideally controlled so that dumpster mounted warning units in other locations are not activated prematurely or inadvertently.

Warning unit 16 includes receiver 54, control circuitry 56, warning indicator or alarm 58 and power source or battery 60. Receiver 54 is of a standard variety capable of receiving signals such as the signal transmitted from transmitter 52 and of providing an output in response to the signal received. In preferred embodiments, receiver 54 includes an antenna for receiving electromagnetic waves such as the signal from transmitter 52.

Control circuitry 56 is coupled to receiver 54 and produces control signals in response to or as a function of the output of receiver 54. Control circuitry 56 can be a microprocessor or a programmable logic controller programmed for this specific task. However, in preferred embodiments, control circuitry 56 can be any digital or analog circuitry capable of producing control signals for controlling warning indicator 58. When receiver 54 provides an output indicative of the approach of a garbage truck, control circuitry 56 produces control signals which cause warning indicator or alarm 58 to emit a warning signal to warn any occupants of the dumpster of the impending danger. Depending upon the specific control features desired, control circuitry 56 can be as simple as a switching device for turning power to warning indicator 58 on and off. In fact, in some embodiments, control circuitry 56 is not needed or is an integral part of receiver 54 or warning indicator 58.

Warning indicator 58 is an alarm device for warning the occupants of dumpster 12 of the approach of the garbage track. As discussed above, warning indicator 58 is preferably a speaker or other device capable of producing high intensity sound waves. The sound waves produced preferably have an intensity level of at least 70 decibels (dB). However, in other embodiments, warning indicator 58 can also be a strobe light or other device capable of producing pulses of bright light inside and/or around the dumpster in order to warn occupants of the dumpster of the approach of the garbage track.

Embodiments in which warning indicator 58 is a light source have several advantages. First, since no high intensity sound waves are produced, people living or working in buildings near dumpster 12 will not be as readily disturbed as they may be in embodiments in which warning indicator 58 produces high intensity sound waves. Second, a light source is more useful in warning deaf individuals who may occupy the dumpster. However, because loud sounds are more likely to alert most persons than are bright fights, warning indicator 58 preferably has the capability of producing high intensity sound waves.

Warning unit 16 also contains a battery 60 or other power sources for powering the various components of warning unit 16. Because disposal of an entire warning unit is likely each time battery 60 needs replacement, battery 60 is preferably of a long-life type.

Warning unit 16 is preferably a water proof assembly. This prevents water or other liquids from damaging the components of warning unit 16 and causing failure or malfunction. In alternative embodiments, the individual components of warning unit 16 can be separate assemblies, although each will still be preferably waterproof.

In operation, system 50 works generally as follows. As the garbage truck approaches garbage dumpster 12, transmitter 52 of warning unit 14 transmits a signal indicative of the approach of the garbage truck. This first signal is received by receiver 54 of warning unit 16, which is attached to dumpster 12. Receiver 54 provides an output to control circuitry 56 which is indicative of the fact that receiver 54 has received the first signal. In response to the output from receiver 54, control circuitry 56 produces control signals which cause warning indicator 58 to emit the appropriate warning signal. The warning signal produced by indicator 58 provides occupants of dumpster 12 with advance notice that the garbage truck is approaching, thus allowing them to seek safety.

FIG. 3 illustrates a second embodiment 70 of warning system 10 in accordance with the present invention. Warning system 70 includes first and second warning units 14 and 16 as was the case with warning system 50 shown in FIG. 2. However, each of warning units 14 and 16 in warning system 70 include some additional components. Warning unit 14 includes transmitter 32, receiver 72, control circuitry 74, and warning indicator 26. Warning unit 16 includes receiver 54, control circuitry 56, warning indicator 58, battery 60, body heat sensor 76, and transmitter 78. Transmitter 52, receiver 54 and warning indicator 58 of warning system 70 function substantially the same as in warning system 50. As is discussed below in greater detail, control circuitry 56 performs more detailed functions than in warning system 50.

Body heat sensor 76 is an infra-red or other type of sensor adapted for sensing thermal energy in or around dumpster 12. In preferred embodiments, body heat sensor 76 is a sensor capable of detecting heat from a source within approximately 10 feet of the sensor. Body heat sensor 76 is coupled to control circuitry 56 and provides an output signal to control circuitry 56 indicative of thermal energy sensed by body heat sensor 76.

Transmitter 78 is a device capable of transmitting a second or a verification signal back to warning unit 14. Transmitter 78 is controlled by control circuitry 56 and can be used to transmit various information back to warning unit 14. For example, transmitter 78 can be used to notify the driver of the garbage track that body heat sensor 76 has sensed sufficient thermal energy to indicate that one or more persons occupy dumpster 12. In this instance, the truck driver would not attempt to dump the garbage in the dumpster until after the occupants have moved to safety. In the alternative, transmitter 78 can be used to send a verification signal to warning unit 14, verifying that warning unit 16 received the first signal from warning unit 14, and that warning unit 16 is functioning properly.

Receiver 72 of warning unit 14 is of a standard variety capable of receiving signals such as the signal transmitted by transmitter 78 of warning unit 16 and of providing an output in response to the signal received. Control circuitry 74 is coupled to receiver 72 and produces first control signals in response to, or as a function of, the output of receiver 72. Control circuitry 74 can be any digital or analog circuitry capable of producing control signals for controlling warning indicator 26.

In preferred embodiments, warning system 70 functions as follows. As the garbage truck approaches garbage dumpster 12, transmitter 52 of warning unit 14 transmits a signal indicative of the approach of the garbage truck. This first signal is received by receiver 54 of warning unit 16, which is attached to dumpster 12. Receiver 54 provides an output to control circuitry 56 which is indicative of the fact that receiver 54 has received the first signal. In response to the output from receiver 54, control circuitry 56 produces first control signals which cause body heat sensor 76 to sense for thermal energy in or around the dumpster. Control circuitry 56 monitors the output of body heat sensor 76 and determines whether sufficient thermal energy is present to indicate that an individual may be in or around the dumpster. If control circuitry 56 determines that one or more persons are in or around the dumpster, it generates second control signals which cause warning indicator 58 m emit the appropriate warning signal. The warning signal produced by indicator 58 provides occupants of dumpster 12 with advance notice that the garbage truck is approaching, thus allowing them to seek safety.

At the same time that warning indicator 58 is being caused to emit a warning signal, control circuitry 56 generates third control signals which cause transmitter 78 to transmit a signal back to warning unit 14. In preferred embodiments, this second transmitted signal is indicative of the presence of one or more persons in or around the garbage dumpster. Receiver 72 of warning unit 14 receives this second signal and provides an output signal to control circuitry 74. In response to the output signal, control circuitry 74 generates control signals which activate warning indicator 26. Warning indicator 26 alerts the operator of the garbage truck of possible occupancy of the dumpster. In other embodiments, the signal transmitted by transmitter 78 is indicative of whether warning unit 16 is functioning properly or whether it is in need of maintenance or replacement.

Although the present invention has been described with reference to preferred embodiments, workers skilled in the art will recognize that changes may be made in form and detail without departing from the spirit and scope of the invention. For example, warning indicators 58 and 26 have been described as either sound or light producing devices. However, indicators 58 and 26 could be other types of devices, such as the type that produce vibrations for warning occupants of the dumpster or the garbage truck driver. Also, indicator 26 can be a display monitor device such as a liquid crystal display (LCD) for providing text warning information to the driver of the garbage truck.

What is claimed is:

1. A method for signaling to an occupant of a garbage receptacle the approach of a vehicle, the method including:

providing a first warning device carried by the vehicle, the first warning device having a transmitter for transmitting a first signal;

transmitting the first signal;

providing a second warning device configured to be carried by the garbage receptacle, the second warning device comprising:

a receiver for receiving the first signal from the first warning device transmitter and for providing an output indicative of receipt of an alarm coupled to the receiver;

receiving the first signal; and warning the occupant of the garbage receptacle of the approach of the vehicle, the alarm warning the occupant of the garbage receptacle as a function of the output of the receiver.

2. The method for signaling of claim 1, wherein warning the occupant includes emitting sounds waves to warn the occupant of the garbage receptacle of the approach of the vehicle.

3. The method for signaling of claim 2, wherein warning the occupant includes producing a sound intensity level of at least 70 decibels.

4. The method for signaling of claim 1, wherein warning the occupant includes producing light pulses to warn the occupant of the garbage receptacle of the approach of the vehicle.

5. The method for signaling of claim 1, further including:

providing a control circuit coupled between the receiver and the alarm, the control circuit generating a first control signal for controlling the alarm as a function of the output of the receiver.

6. The method for signaling of claim 5, further including:

providing a body heat sensor coupled to the control circuit for detecting the presence of one or more persons in the garbage receptacle and for providing an output indicative of the presence of a person in the garbage receptacle, the control circuit generating the first control signal for controlling the alarm as a function of the body heat sensor output such that the alarm does not warn of the approach of the vehicle unless one or more persons are present in the garbage receptacle.

7. The method for signaling of claim 5, further including:

providing a transmitter coupled to the control circuit for transmitting a second signal, the control circuit generating a second control signal for controlling the transmitter of the second warning device such that the second signal is transmitted only upon receipt of the first signal from the first warning device transmitter by the receiver of the second warning device.

8. The method for signaling of claim 7, further including:

providing a receiver for receiving the second signal from the second warning device transmitter and for providing an output indicative of receipt of the second signal, receiving the second signal;

providing an alarm coupled to the first warning device receiver; and notifying the operator of the vehicle of receipt of the second signal, the alarm notifying the operator as a function of the output of the first warning device receiver.

9. The method for signaling of claim 1, wherein transmitting includes transmitting the first signal continuously.

10. The method for signaling of claim 1, further including;

activating the transmitter by the person on the vehicle.

11. The method for signaling of claim 1 and further including:

providing a locking mechanism for removably securing the second warning device to the garbage receptacle.

12. The method for signaling of claim 1, wherein the second warning device is self-powered.

13. The method for signaling of claim 1, further including:

providing a battery for powering the receiver and the alarm.

14. A warning system for signaling to an occupant of a garbage dumpster the approach of a garbage truck, the warning system comprising:

a first warning unit carried by the garbage truck, the first warning unit having a means for transmitting a first signal; and a second warning unit configured to be carried by the garbage receptacle, the second warning unit comprising:

means for receiving the first signal from the first warning unit;

body heat sensor means for detecting the presence of a person in the garbage dumpster and for providing an output indicative of presence of a person in the garbage dumpster; and means for generating a warning signal for warning the occupant of the garbage dumpster of the approach of the garbage truck when the means for receiving has received the first signal.

15. The system of claim 14 wherein the means for warning further comprises:

means for generating the warning signal only when both the means for receiving has received the first signal and the means for detecting has detected the presence of a person in the garbage dumpster.

16. The system of claim 14 wherein the second warning unit comprises a means for transmitting a second signal when the means for detecting has detected of a person in the garbage dumpster, and the first warning unit further comprising:

means for receiving the second signal from the second warning unit; and means for warning the operator of the vehicle of the presence of a person in the garbage dumpster when the means for receiving has received the second signal.

17. The system of claim 14 wherein the second warning unit further comprises a means for transmitting a verification signal when the means for receiving has received the first signal, the first warning unit further comprising:

means for receiving the verification signal; and means for notifying an operator of the garbage truck of whether or not the verification signal has been received by the first warning unit, and thus of whether or not the warning system is functioning properly.

18. The system of claim 14, wherein the second warning unit is self-powered.

19. The system of claim 18, wherein the second warning unit further comprises:

a battery for powering the means for receiving the first signal and the means for generating a warning signal.

* * * * *

UNITED STATES PATENT AND TRADEMARK OFFICE

CERTIFICATE OF CORRECTION

PATENT NO. : 5,657,007

DATED : AUGUST 12, 1997

INVENTOR(S) : THOMAS M. ANDERSON, PATRICK E. POWERS

It is certified that error appears in the above-identified patent and that said Letters Patent is hereby corrected as shown below:

Col. 1, line 11, delete "building", insert --buildings--

Col. 1, line 11, delete "dumpster", insert --dumpsters--

Col. 1, line 20, delete "dumpster", insert --dumpsters--

Col. 1, line 27, delete "dumpster", insert --dumpsters--

Col. 1, line 55, delete "track", insert --truck--

Col. 1, line 66, delete "of", insert --if--

Col. 2, line 41, delete "dosed", insert --closed--

Col. 2, line 47, delete "track", insert --truck--

Col. 4, line 15, delete "track", insert --truck--

Col. 4, line 22, delete "track", insert --truck--

Col. 4, line 31, delete "fights", insert --lights--

Col. 5, line 21, delete "track", insert --truck--

Col. 5, line 55, delete "m", insert --to--

UNITED STATES PATENT AND TRADEMARK OFFICE

CERTIFICATE OF CORRECTION

PATENT NO. : 5,657,007

DATED : AUGUST 12, 1997

INVENTOR(S) : THOMAS M. ANDERSON, PATRICK E. POWERS

It is certified that error appears in the above-identified patent and that said Letters Patent is hereby corrected as shown below:

Col. 6, delete lines 33-36, insert the following

--a receiver for receiving the first signal from the first warning device transmitter and for providing an output indicative of receipt of the first signal;

an alarm coupled to the receiver [for];--

Signed and Sealed this

Thirty-first Day of March, 1998

*Attest:*

*Attesting Officer*

Bruce Lehman

BRUCE LEHMAN

*Commissioner of Patents and Trademarks*